US005976207A

United States Patent [19]

Vollmer

[11] Patent Number: 5,976,207

[45] Date of Patent: Nov. 2, 1999

[54] WATER SEPARATING SYSTEM

[75] Inventor: Wolfgang Vollmer, Erlangen, Germany

[73] Assignee: Siemens Aktiengesellschaft, Munich, Germany

[21] Appl. No.: 09/153,207

[22] Filed: Sep. 15, 1998

Related U.S. Application Data

[63] Continuation of application No. PCT/DE97/00396, Mar. 4, 1997.

[30] Foreign Application Priority Data

Mar. 15, 1996 [DE] Germany ..... 196 10 317

[51] Int. Cl.[6] ..... B01D 45/12

[52] U.S. Cl. ..... 55/309; 55/312; 55/459.1; 122/492

[58] Field of Search ..... 55/309, 312, 459.1, 55/459.2, 337; 122/492

[56] References Cited

U.S. PATENT DOCUMENTS

| | | | |
|---|---|---|---|
| 323,891 | 8/1885 | Stratton | 55/459.1 |
| 1,752,231 | 3/1930 | Clarkson | 55/459.1 |
| 1,766,666 | 6/1930 | Meyer | 55/459.2 |
| 3,349,548 | 10/1967 | Boyen . | |
| 3,788,044 | 1/1974 | McNeil | 55/459.1 |
| 4,328,013 | 5/1982 | Godare et al. | 55/459.1 |

FOREIGN PATENT DOCUMENTS

| | | | |
|---|---|---|---|
| 0158891A1 | 10/1985 | European Pat. Off. . | |
| 961953 | 5/1950 | France . | |
| 283108 | 3/1915 | Germany . | |
| 728630 | 11/1942 | Germany . | |
| 884369 | 7/1953 | Germany . | |
| 2620347 | 10/1977 | Germany . | |
| 4229847A1 | 3/1994 | Germany . | |
| 4242144A1 | 6/1994 | Germany . | |
| 370978 | 2/1973 | U.S.S.R. | 55/459.1 |

*Primary Examiner*—Duane S. Smith
*Attorney, Agent, or Firm*—Herbert L. Lerner; Laurence A. Greenberg

[57] ABSTRACT

A water separating system for separating water from a water/water vapor mixture includes at least one inlet tube disposed on the periphery of a vessel, as well as an outlet tube for steam provided above the inlet tube. In order to achieve a separation quality which is as high as possible, a separation apparatus, preferably in the form of a tube bend, for partial-stream steam is connected in parallel with the vessel on the inlet side.

8 Claims, 2 Drawing Sheets

WATER SEPARATING SYSTEM

CROSS-REFERENCE TO RELATED APPLICATION

This application is a continuation of copending International Application No. PCT/DE97/00396, filed Mar. 4, 1997, which designated the United States.

BACKGROUND OF THE INVENTION

1. Field of the Invention

The invention relates to a water separating system for separating water from a water-vapor mixture, having at least one inlet tube disposed on the periphery of a vessel and having an outlet tube for steam provided above the inlet tube.

Such a water separating system having a water separator, which is known, for example, from German Published, Non-Prosecuted Patent Application DE 42 42 144 A1, is usually used in the evaporation system of a once-through or forced once-through steam generator. It serves for separating water from a water/water vapor mixture at the end of a heating surface of the steam generator referred to as an evaporator. It is intended that the system should prevent water from passing into downstream superheater heating surfaces. Such an interference with medium impingement on heating surface inlets leads to different mass flows in the heating surfaces due to heating. The resulting different cooling may lead to impermissible excess temperatures and thus to damage to tubes of the heating surfaces.

The water/water vapor mixture which often flows tangentially into the water separator through conventionally inclined inlet tubes is separated in a vessel by a combination of gravity and centrifugal forces. In the process, the water is separated onto vessel walls and flows downwards, while due to the inclination of the inlet tubes, the steam is initially conducted downwards and, following a flow reversal in the separator, is drawn off in an upper region of the vessel.

However, as the steam content and steam generator loading increase, a cross-section of flow defined by a ratio of downward flow and upward flow becomes narrower, so that the velocities of the mixture components increase and the pressure loss rises. Since water droplets are entrained by the steam due to the comparatively high velocity of the water/water vapor mixture, the separation quality becomes progressively poorer. Furthermore, as the number of inlet tubes increases, the exit conditions of the mixture jet are increasingly impaired.

Published French Patent Application 961 953 has disclosed a water separating system in which a separation apparatus for a partial-stream steam is connected upstream of a vessel on the inlet side.

SUMMARY OF THE INVENTION

It is accordingly an object of the invention to provide a water separating system, which overcomes the hereinaforementioned disadvantages of the heretofore-known devices of this general type and which has a particularly high separation quality.

With the foregoing and other objects in view there is provided, in accordance with the invention, a water separating system for separating water from a water-vapor mixture, comprising a vessel having a periphery and an inlet side; at least one inlet tube connected to the vessel at the periphery; an outlet tube for steam connected to the vessel above the inlet tube; a tube bend connected to the at least one inlet tube upstream of the vessel on the inlet side; and a partial-stream steam line branching off from the tube bend for separating off partial-stream steam.

The invention is based on the concept of relieving an existing water separator in terms of flow through the use of a prior separation of partial-stream steam.

Steam is drawn off above the vessel of the water separating system by using the pressure difference, even before the actual water separation, through the use of this separation apparatus which is connected upstream of the vessel of the water separating system and is disposed parallel therewith. The steam can be admixed with the steam flowing out of the water separator. In the process, the centrifugal action in the tube bend is utilized and a partial quantity of the steam is drawn off in the region of a water-steam layering which forms in the tube bend.

In accordance with another feature of the invention, in order to maintain a centrifugal separation within the vessel, the inlet tube or each inlet tube is disposed tangentially and/or runs obliquely at an angle of inclination at the periphery of the vessel.

A flow towards the upstream separation apparatus may take place from above or below. Therefore, in accordance with a further feature of the invention, the tube bend of the separation apparatus is curved upwards or downwards.

In accordance with an added feature of the invention, particularly in the event of a flow arriving from below, a water drainage device from the upstream separation apparatus to the vessel of the water separator is provided. To this end, a water drainage line may be connected to the partial-stream steam line and/or a water drainage container may be connected into the partial-stream steam line.

In accordance with an additional feature of the invention, in the case of an upwardly curved tube bend of the upstream separation apparatus, that end of the partial-stream steam line which faces the tube bend is expediently branched, while in the case of a downwardly curved tube bend that end of the steam stream line preferably has a siphon-like structure.

In accordance with a concomitant feature of the invention, the steam lines from the vessel of the water separator and the separation apparatus connected upstream of the latter may be combined directly downstream of the water separator or in a collection system disposed above them. The outlet tube and the partial-stream steam line are then connected to one another or to the common collection system.

The advantages which can be achieved by using the invention are, in particular, the fact that the pressure loss in the water separating system is reduced due to a partial-stream steam which is separated off on the inflow side of the separator and is guided parallel with the latter. The steam velocity in the separator is reduced due to the resulting reduced flow of steam to the actual separator, so that entrainment of water droplets in the separated steam stream is avoided.

Moreover, constructing the separation apparatus in the form of a tube bend with a connected partial-stream steam line makes it possible for the actual separator to have particularly small dimensions and small wall thicknesses. This in turn leads to a particularly low overall pressure loss of the water separating system and, due to the small wall thicknesses, to a particularly favorable performance in the event of temperature changes.

Other features which are considered as characteristic for the invention are set forth in the appended claims.

Although the invention is illustrated and described herein as embodied in a water separating system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
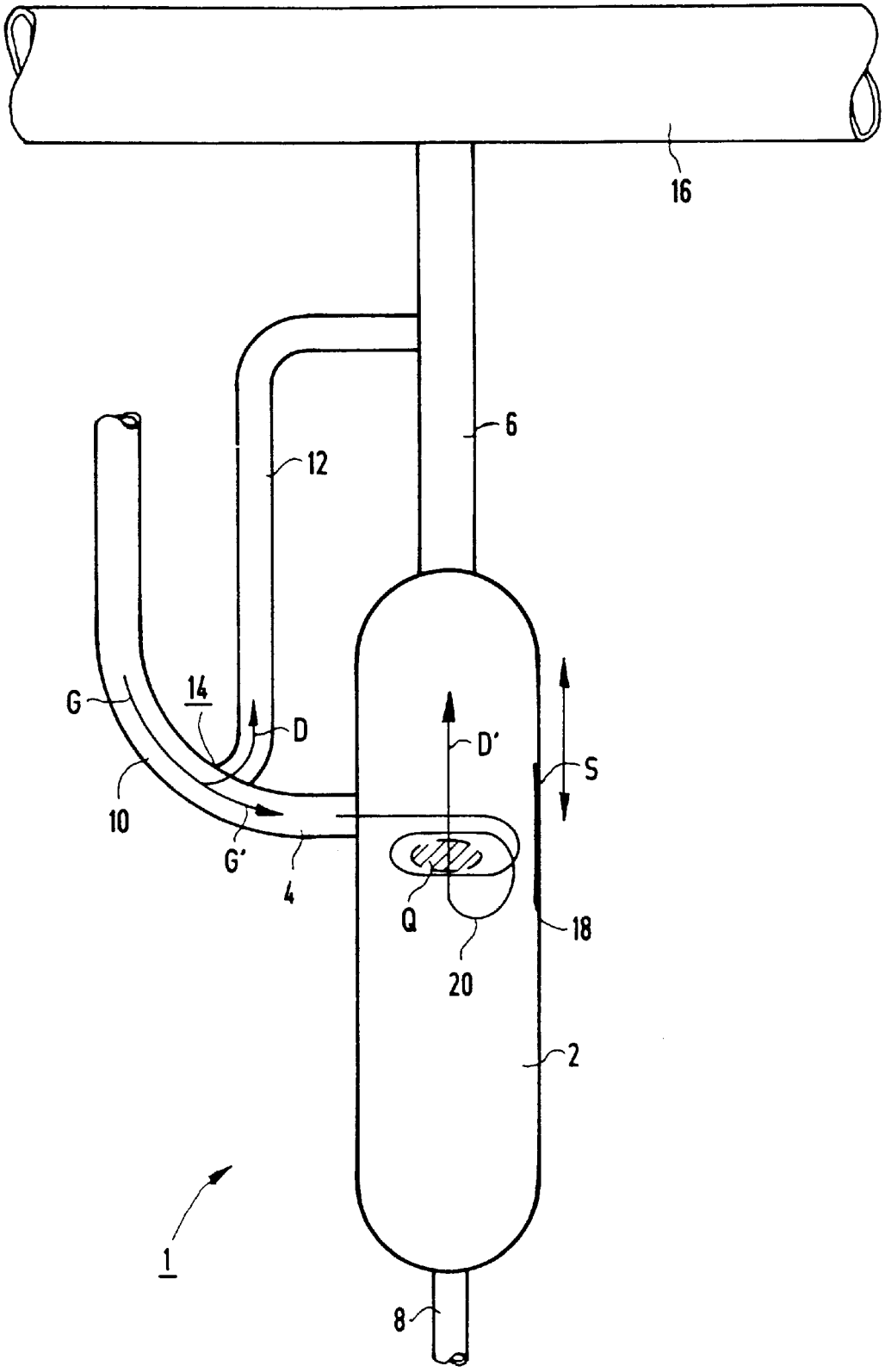
FIG. 1 is a fragmentary, diagrammatic, elevational view of a water separating system with an upwardly curved inlet tube bend.

Referring now in detail to the figures of the drawings, in which parts that correspond to one another are provided with identical reference symbols, and first, particularly, to FIG. 1 thereof, there is seen a water separating system 1 which includes a closed vessel 2 with an inlet tube 4 that is disposed so as to run obliquely, an outlet tube 6 which is disposed so as to run axially, as well as a likewise axial water discharge 8. Instead of the axial outlet tube 6, it is also possible to provide a plurality of exhaust tubes which run, for example, obliquely or radially.

An inflow side of the inlet tube 4 merges into an upwardly curved tube bend 10. The tube bend 10, and a partial-stream steam line 12 connected in the tube region, together form a separation apparatus 14 connected upstream of the vessel 2 and disposed parallel therewith.

The partial-stream steam line 12 is connected to the outlet tube 6, which opens into a steam-collection system 16.

During operation of the water separating system 1, a water/water vapor mixture G flows through the tube bend 10 of the inlet tube 4 into the vessel 2. The flow towards the tube bend 10 in this case takes place from above. Through the use of the separation apparatus 14, partial-stream steam D is drawn off upstream of the vessel 2 through the tube bend 10 and the partial-stream steam line 12 and is fed to the steam system 16 downstream of the vessel 2. In this process, centrifugal force in the tube bend 10 is utilized and a partial quantity of steam is separated off per unit time in the region of a water-steam layering which forms in the tube bend 10. In the process, the partial-stream steam D is adjusted in accordance with pressure conditions in the water separating system 1, i.e. in the vessel 2 and in the parallel or partial-stream steam line 12.

A remaining water/water vapor mixture G' flows into the vessel 2 through the inlet tube 4. Due to an inflowing jet striking walls 18 of the vessel 2, there forms a surge S which is in equilibrium with velocity conditions. If loads were to rise due to a high steam content, a steam stream D' separated in the vessel 2 would entrain water droplets. This is avoided through the use of the upstream separation apparatus 14.

Water is separated out of the water/water vapor mixture G' at the walls 18 of the vessel 2 if the water/water vapor mixture G' flows in through the inlet tube 4 which is preferably inclined and tangentially disposed. Due to the inclination of the inlet tubes 4, the steam is firstly guided downwards and, following a flow reversal in the vessel 2, is drawn off axially upwards. The flow profile is illustrated by a curve 20. With increasing steam content and increasing load, a cross-section of flow Q becomes narrower, so that the flow velocity increases and the pressure loss rises. The separation quality would then deteriorate, since droplets are entrained at high velocities. This is avoided by the parallel guidance of the partial-stream steam D upstream of the vessel 2, since the amount of stream fed to the vessel 2, and thus also the steam velocity, is then comparatively low.

Figure 2:
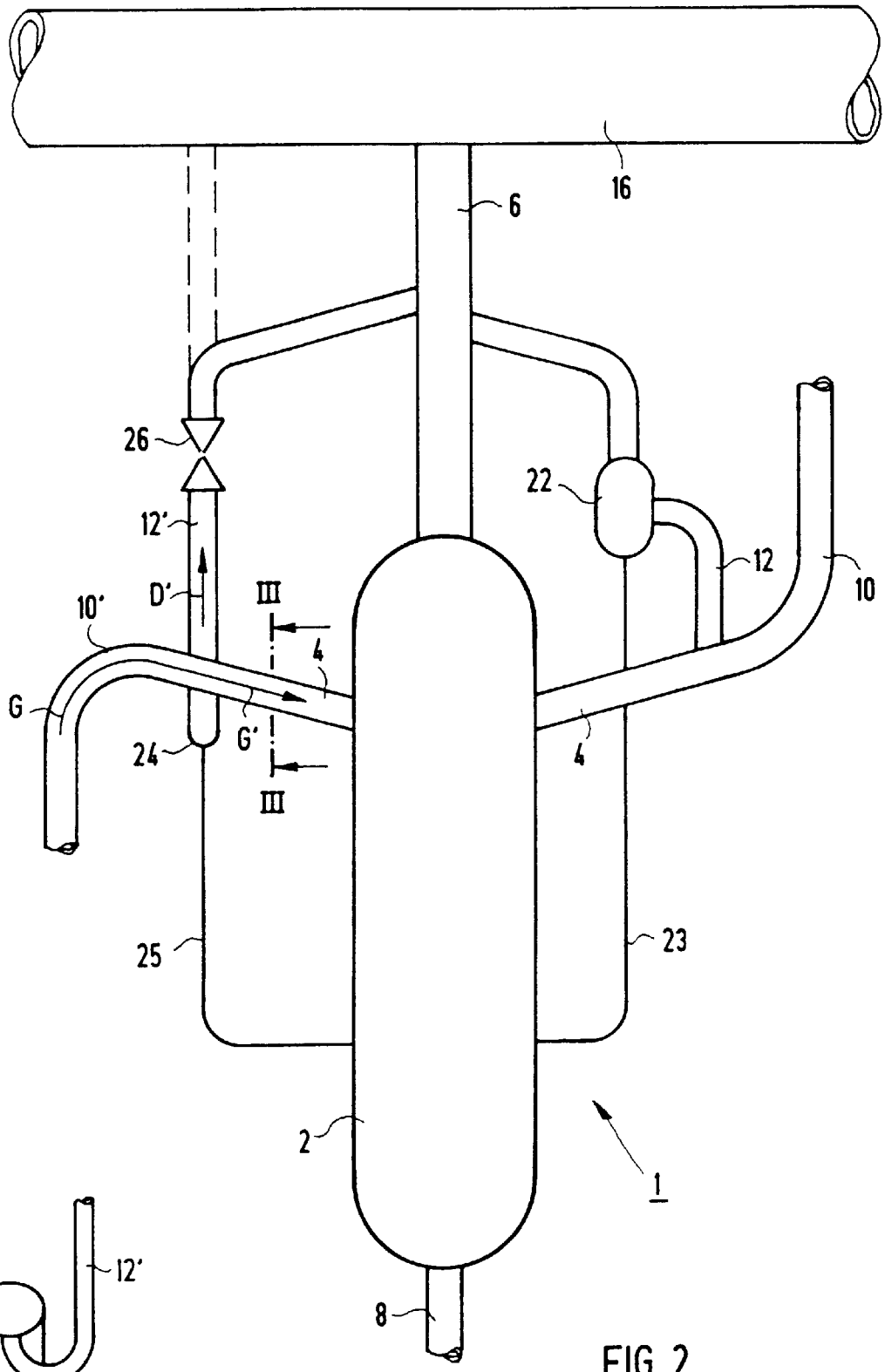
FIG. 2 is a view of a water separating system similar to FIG. 1, with a downwardly curved and an upwardly curved inlet tube bend.
Figure 3:
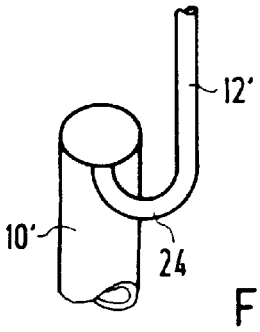
FIG. 3 is an elevational view of a section of the device as seen along a line III—III of FIG. 2, in the direction of the arrows, with a tube bend having a siphon-like structure.

In FIG. 2, the vessel 2 is depicted as having two inlet tubes 4. While a tube bend 10 depicted on the right-hand side of the figure is curved upwards, a tube bend 10' depicted on the left-hand side of the figure is curved downwards. A water drainage container 22 is connected into a partial-stream steam line 12 which is branched at an end facing the tube bend 10. The water drainage container 22 is connected to a lower region of the vessel 2 through a water drainage line 23. The water drainage of the downwardly curved tube bend 10' is effected through a siphon 24, which forms part of a partial-stream steam line 12'. The siphon 24 is likewise connected to the lower region of the vessel 2 through a water drainage line 25. A siphon-like structure of that end of the partial-stream steam line 12' which faces the tube bend 10' is illustrated in FIG. 3.

The partial-stream steam lines 12, 12' are connected to the outlet tube 6. As is illustrated in dashed lines on the left-hand side of FIG. 2, the partial-stream steam line 12' may also be connected directly to the steam-collection system 16. In order to influence the pressure loss in the partial-stream steam line 12', a restrictor or a valve 26 is connected into the latter.

It is possible to provide a plurality of inlet tubes 4 that are distributed over the periphery of the vessel 2 and have any desired combinations of upwardly and downwardly curved tube bends 10, 10'. However, the number of inlet tubes 4 should be kept to a few, since as the number of inlet tubes 4 increases, the exit conditions of the jet, represented by the curve 20, are impaired.

A particularly high separation quality is achieved due to favorable flow conditions in the vessel 2 and due to the branching off of the partial-stream steam D, D' upstream of the actual separator through the use of the separation apparatus 14. Furthermore, particularly small dimensions of the water separating system 1 may be selected, so that particularly favorable conditions with regard to temperature changes are provided. In addition, the pressure loss in the water separating system 1 is particularly low, especially when operated at full load.

I claim:

1. A water separating system for separating water from a water-vapor mixture, comprising:

a vessel having a periphery and an inlet side;

at least one inlet tube connected to said vessel at said periphery;

an outlet tube for steam connected to said vessel above said inlet tube;

a tube bend connected to said at least one inlet tube upstream of said vessel on said inlet side; and a partial-stream steam line branching off from said tube bend for separating off partial-stream steam.

2. The water separating system according to claim 1, wherein said at least one inlet tube runs obliquely.

3. The water separating system according to claim 1, wherein said tube bend is curved upwards.

4. The water separating system according to claim 1, wherein said tube bend is curved downwards.

5. The water separating system according to claim 1, including a water drainage line connected to said partial-stream steam line.

6. The water separating system according to claim 1, including a water drainage container connected into said partial-stream steam line.

7. The water separating system according to claim 1, wherein said partial-stream steam line has an end facing said tube bend with a siphon structure.

8. The water separating system according to claim 1, including a common steam-collection system, said partial-stream steam line and said tube bend forming a separation apparatus, and said outlet tube and said separation apparatus connected to said common steam-collection system.

* * * * *